US006216768B1

(12) United States Patent
Daussan et al.

(10) Patent No.: US 6,216,768 B1
(45) Date of Patent: Apr. 17, 2001

(54) DEVICE FOR FILTERING AND TREATING MOLTEN METAL

(75) Inventors: Jean Daussan, Metz; Gérard Daussan; André Daussan, both of Longeville les Metz, all of (FR)

(73) Assignee: Daussan et Compagnie, Woippy (FR)

( * ) Notice: Subject to any disclaimer, the term of this patent is extended or adjusted under 35 U.S.C. 154(b) by 0 days.

(21) Appl. No.: 09/244,025

(22) Filed: Feb. 4, 1999

(30) Foreign Application Priority Data

Feb. 11, 1998 (FR) ..... 98 01634

(51) Int. Cl.[7] ..... B22D 27/20
(52) U.S. Cl. ..... 164/358; 164/58.1
(58) Field of Search ..... 164/358, 55.1, 164/56.1, 57.1, 58.1, 59.1, 134

(56) References Cited

U.S. PATENT DOCUMENTS

| | | | | |
|---|---|---|---|---|
| 3,658,115 | | 4/1972 | Ryntz, Jr. et al. . | |
| 5,603,373 | * | 2/1997 | Daussan et al. | 164/58.1 |
| 5,690,161 | * | 11/1997 | Daussan et al. | 164/58.1 |

FOREIGN PATENT DOCUMENTS

| | | |
|---|---|---|
| 0 249 897 | 12/1987 | (EP) . |
| 0 578 517 A1 | 1/1994 | (EP) . |
| 62-185859 | 8/1987 | (JP) . |

* cited by examiner

*Primary Examiner*—Kuang Y. Lin
(74) *Attorney, Agent, or Firm*—Young & Thompson

(57) ABSTRACT

The ratio of the number of free holes (4*a*) in a filtering plate (2, 3), located in the areas (9) which are not covered by the an insert (7) of treating material, on the one hand, to the total number of holes (4, 4*a*) in said filtering plate (2, 3), on the other hand, is not less than 10% and/or not above 75%.

25 Claims, 1 Drawing Sheet

DEVICE FOR FILTERING AND TREATING MOLTEN METAL

BACKGROUND OF THE INVENTION

The present invention relates to a device for filtering and treating molten metal.

According to EP-A-0 578 517, a device for filtering and treating molten metal includes a set of at least two filtering plates, consisting of a refractory mineral material and having through-holes for the passage and the filtration of the molten metal, such plates being kept at a certain distance apart by means of peripheral walls so as to provide, between them, a cavity receiving an insert made of a treating material for said molten metal and having such a shape that, as seen in the direction of flow of the liquid metal, the insert leaves at least one uncovered area on the filtering plates.

The area of the first filtering plate (upstream), which is not covered by the insert of treating material, includes free filtering holes, allowing the molten metal to enter the cavity, contact the treating material of the insert and flow around the insert before leaving the cavity through the free filtering holes in the second filtering plate (downstream).

It can therefore be noted that the molten metal flows freely through the device as soon as the casting process begins, after having been brought in contact with the treating material present in the device cavity, with the result that a quite homogeneous treatment of the molten metal can be obtained right from the beginning and up to the end of the casting of said metal.

Such a device is suitable for a prefabrication by the filter supplier, according to the end user's requirements.

However, the end user, as a general rule a foundry, has two conflicting requirements.

On the one hand, based on the fact that the weight of a given treating material must be a known fraction of the weight of the molten metal-flowing through the device during a predetermined casting process, the user requires devices with different predetermined respective weights of treating material, constituting a set. Such a set may range, for instance as regards an inoculating material for the casting of spheroidal-graphite cast iron, from ten grams to 150 grams or more, in successive steps 10 grams by 10 grams, or 20 grams by 20 grams.

Besides, various treating materials are used depending on the nature of the molten metal to be treated, such various treating materials having different densities and being used in different proportions in relation to the weight of the molten metal to be treated.

On the other hand, and on standardisation grounds for the equipment used, the user wants to limit as much as possible the number of devices with various sizes, necessary for meeting his requirements.

Therefore the Applicant has been led to investigate the feasibility of placing, in the cavity of a device used for filtering and treating molten metal, different quantities of various treating materials. Some tests, carried out by the Applicant, have revealed, in certain cases, a decrease in the quality and/or homogeneity of the treatment of molten metal in the course of a casting process.

SUMMARY OF THE INVENTION

It is the object of the present invention to cope with the above-mentioned shortcomings of the known devices and to provide a device of the above-mentioned type, capable of holding various quantities of different treating materials, while nevertheless providing for the quality and homogeneity of the treatment of molten metal in the course of a casting process.

According to a first aspect of the present invention the device of the above-mentioned type, intended for the filtration and the treatment of molten metal, is characterised in that the ratio of the number of free holes in a filtering plate, located in the areas which are not covered by the insert of treating material, on the one hand, to the total number of holes in said filtering plate, on the other hand, is not less than 10% and/or not above 75%, and advantageously not less than 20% and/or not above 65% and, more preferably, not less than 35% and/or not above 50%.

As can be seen, a minimum percentage of free holes is required for allowing the passage of molten metal through the device according to the invention, as soon as a casting process starts.

It will also be easily understood that such percentage of free holes should not be too high: as a matter of fact, the area of the insert of treating material in contact with the molten metal must be great enough for an even and sufficient transfer of the treating material into said metal.

Thus, by controlling the ratio of the number of free holes to the total number of holes in a filtering plate, it is possible to insert into the cavity of a device having preset dimensions, the greatest possible number of inserts with various weights of different treating materials, yet without a decrease in the quality and homogeneity of the treatment of molten metal. It results in the smallest possible number of devices having different dimensions.

According to an advantageous facet of the invention, the ratio of the space not occupied in the cavity by the insert of treating material, on the one hand, to the total volume of said cavity, on the other hand, is not less than 20% and/or not above 80%, and advantageously not less than 30% and/or not above 75% and, more preferably, not less than 35% and/or not above 72%.

It will readily be understood that a minimum percentage of space must remain unoccupied by the insert of treating material inside the cavity, to allow for the flowing of the molten metal in such free space, in contact with the treating material right from the beginning of the casting process and through it.

Yet such percentage of free space should not be too high. In fact, the contact conditions between molten metal and treating material must remain substantially even and steady through the whole casting process for an even, homogeneous, reliable and reproducible quality of the treatment of the molten metal during the whole process.

According to a preferred embodiment of the present invention, for an inoculation treatment of molten cast iron, the ratio, expressed in dm×sec, of the weight in kg of the cast metal, on the one hand, to the module of the insert, in dm, multiplied by the cast metal velocity inside the filter cavity, expressed in dm/sec, on the other hand, is in the order of 70D±50%, advantageously in the order of 70D±35%, and preferably in the order of 70D±20%, D being the density of the molten metal as expressed as a dimensionless ratio of the mass of a predetermined volume of the metal to the mass of the same volume of water.

Another aspect of this invention relates to the use of a device according to the first aspect of the invention, in a method of mould casting a molten metal, comprising the steps of interposing a filter and a treating material on the way of the metal before said metal enters the actual mould.

BRIEF DESCRIPTION OF THE DRAWING

Other features and advantages of the present invention will become apparent upon reading the following description, by way of example only, with reference to the accompanying drawings, in which.

DESCRIPTION OF THE PREFERRED EMBODIMENT

The drawings show a device 1 intended to filter and treat molten metal.

Figure 1:
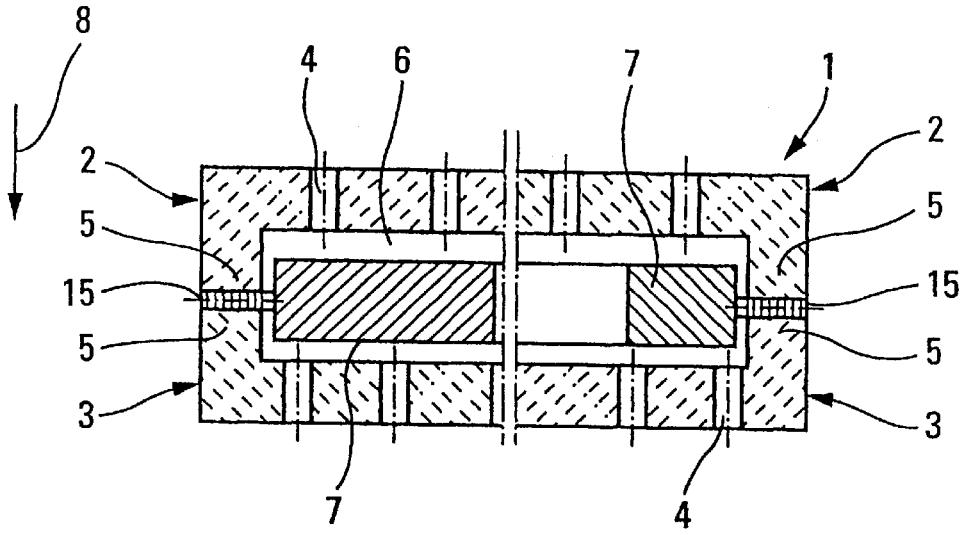
FIG. 1 is a cross-sectional view along the line I—I of FIG. 2, of an embodiment of a device according to the present invention, such device comprising, in its left-hand half part in the drawing, an insert of a treating material having a first shape and, in its right-hand half part in the drawing, an insert of a treating material having another shape.
Figure 2:
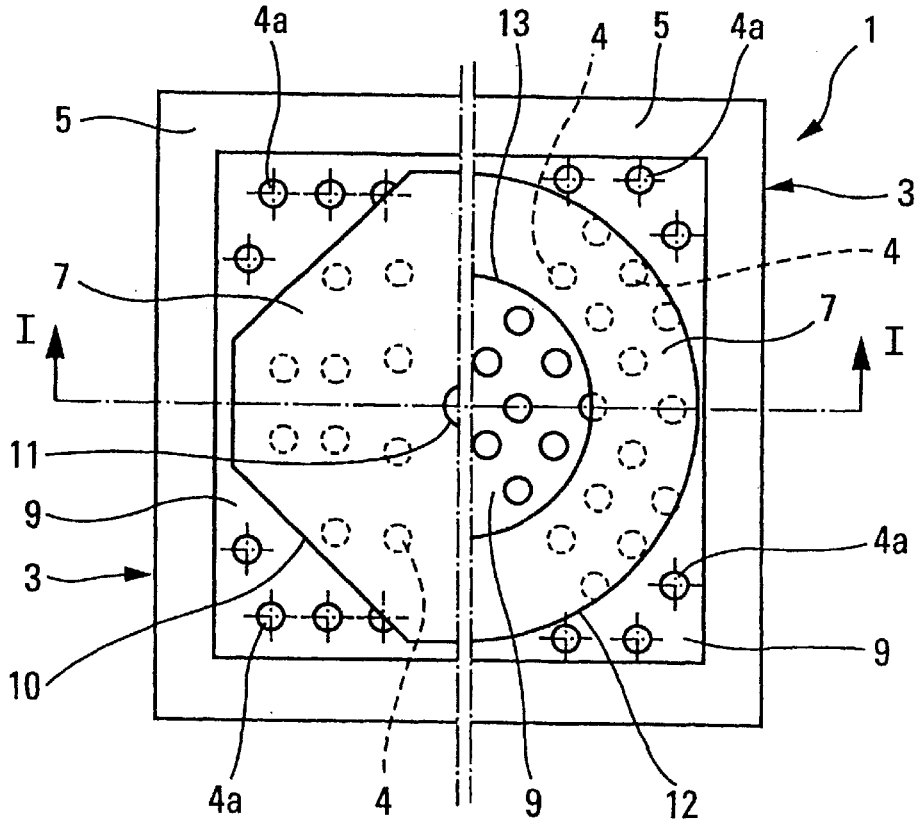
FIG. 2 is a top view of the device of FIG. 1, the upstream filtering plate being removed for the sake of the clarity of the drawing.

Such device comprises a set of at least two filtering plates 2, 3, consisting of a refractory mineral material and having through-holes 4, 4*a* for the passage and the filtration of the molten metal. FIGS. 1 and 2 show only a part of the filtering holes 4, 4*a* for a better understanding of these drawings.

Such filtering plates are kept at a preset distance apart by means of peripheral walls 5 so as to provide, between them, a cavity 6 receiving an inserting 7 made of a treating material for said molten metal and having such a shape that, as seen in the direction of flow 8 of the molten metal, the insert 7 leaves at least one uncovered area 9 on the filtering plates 2, 3.

In the direction of the arrow 8, showing in FIG. 1 the direction of flow of the molten metal, the plate 2 is the upstream or upper plate and the filtering plate 3 is the downstream or lower one.

In the embodiment illustrated in FIG. 1, each filtering plate 2, 3 has side peripheral walls 5 projecting towards each other while providing the cavity 6. In this instance, the filtering plates 2, 3 are connected up by means of a gasket 15, e.g. consisting of refractory cement.

Such device 1 is suitable for a use in a method of mould casting molten metal, comprising the steps of interposing a filter and a treating material on the way of the molten metal before said metal enters the actual mould.

According to the present invention, the ratio R1 of the number of free holes 4*a* in a filtering plate 2, 3, located in the areas 9 which are not covered by the insert 7 of treating material, on the one hand, to the total number of holes 4, 4*a* in said filtering plate 2, 3, on the other hand, is not less than 10% and/or not above 75%.

Yet for a better understanding, it should be specified that this means that the ratio R1 complies with either one or the other or both of the following requirements:

R1 is not less than 10%;

R1 is not above 75%.

Advantageously, the ratio R1 is not less than 20% and/or not above 65%.

More preferably, the ratio R1 is not less than 35% and/or not above 50%.

In the same way, the ratio R2 of the space not occupied in the cavity 6 by the insert 7 of treating material, on the one hand, to the total volume of said cavity 6, on the other hand, is not less than 20% and/or not above 80%.

It means that the ratio R2 complies with either one or the other or both of the following requirements:

R2 is not less than 20%;

R2 is not above 80%.

Advantageously, the ratio R2 is not less than 30% and/or not above 75%.

Preferably, the ratio R2 is not less than 35% and/or not above 72%.

In a well-known manner, the treating material, constituting the insert 7, is selected from desulfurizing, heat-producing, inoculating, spherodizing, recarburizing, refining, modifying agents, and from addition alloys.

As is well known, the weight of the treating material ranges from about 0.001% to about 1% of the weight of the molten metal to be treated.

The filtrating holes 4, 4*a* have, in general, a diameter in the range from about 1.5 mm to about 3 mm, preferably in the range from about 1.8 to about 2.5 mm.

The treating material, forming the insert 7, is with advantage an inoculating material chosen from the following compositions iron alloys, magnesium and magnesium compounds, calcium and barium, silicon, zirconium, aluminium compounds, rare earths, graphite, carbon, for the inoculation treatment of molten cast iron.

In the example illustrated in the left-hand half part of FIGS. 1 and 2, the insert 7 has, as seen in a projection on a plane perpendicular to the direction 8 of flow of the metal, an octagonal outer contour 10 and it comprises a central hole 11, the diameter of which is greater than that of the filtering holes 4, 4*a*.

In the example illustrated in the right-hand half part of FIGS. 1 and 2, the insert 7 has, as seen in a projection, the shape of a circular crown, defined by an outer circular contour 12, the diameter of which is slightly smaller than the width of the cavity, having here a square section, and by an inner circular contour 13.

The filtering plates 2 and 3 are plates made of a refractory mineral material, subjected to a furnace firing. The holes 4, 4*a*, all of them having the same diameters in the example shown in the drawings, might have different diameters in one plate 2 or 3 compared with the other plate 3 or 2, or even within the same plate.

The plates 2 and 3 can be manufactured together with their holes using pressure moulding or pressure extrusion and then be fired in a furnace.

They may comprise the projecting peripheral walls 5 as illustrated in the figures. Such walls may be omitted too, in which case the plates are assembled using a peripheral distance piece with two gaskets, such as 15.

The filtering plates 2 and 3 may have an outer contour of any whatever shape, e.g. square as shown in the illustrated example, but just as well round, rectangular or else.

Likewise, the cavity 6 may have an inner contour of any whatever shape, corresponding to that of the outer contour of the filtering plates 2, 3.

As concerns the insert 7, made of a treating material, it has an outer contour, the shape of which corresponds to that of the inner contour of the cavity, so that the insert 7 may be inserted into the cavity 6 while leaving a number of free holes 4*a* in the filtering plates 2 and 3, adequate to the even, homogeneous, reliable and reproducible quality of the treatment of the molten metal during the whole casting process.

The above-mentioned values regarding the ratio of the number of free holes 4*a* in a filtering plate 2, 3 to the total number of holes 4, 4*a* in said plate are given on the understanding that all the holes 4, 4*a* have the same diameters.

In this case, the relation between the numbers of respective holes equals the relation between the cross-sectional areas of the respective holes, and it is substantially equal to the ratio of the surface area of the uncovered areas 9, on the one hand, to the total surface area of the cavity, on the other hand.

Thus in the example illustrated in the left-hand half parts of FIGS. 1 and 2, it is proven, according to the dimensions as shown, that the insert 7 of a treating material having an octagonal shape has, in projection, such a surface area that the ratio of the surface area of the areas 9, which are not covered by the insert 7, on the one hand, to the total surface area of the cavity, on the other hand, amounts to about 41%. In consequence, the ratio of the number of free holes to the total number of holes amounts to about 41%.

In the same way, in the example illustrated in the right-hand half parts of FIGS. 1 and 2, it can be checked, according to the dimensions as shown, that the insert 7 of a treating material in the shape of a circular crown, has in projection such a surface area that the ratio of the surface area of the areas 9, which are not covered by the insert 7, on the one hand, to the total surface area of the cavity 6, on the other hand, amounts to about 53%. As a result, the ratio of the number of free holes to the total number of holes amounts to about 53%.

The drawings also reveal that the ratio R2 of the space not occupied in the cavity 6 by the insert 7 of treating material, on the one hand, to the total volume of said cavity 6, on the other hand, taking into account the thicknesses as shown for the cavity 6 and for the insert 7, amounts to about 61% as concerns the octagonal plate illustrated in the left-hand half parts of the drawings, and to about 69% for the plate in the shape of a cylindrical crown illustrated in the right-hand half parts of the drawings.

Tables 1 and 2 sum up, in examples 1 through 17, the characteristics of tests carried out by the Applicant, in confidence and privately. These tables show, for each filter, the length L, the width w, the height h of the filter and the diameter Ø of the holes, all of them in millimeters, the weight of the insert in grams, for each filter, the front surface area a in $mm^2$, the number b of holes, the diameter c of the holes, the cross-sectional area d in $mm^2$ for all the holes altogether; as regards the filter cavity, the surface area e of the cavity in $mm^2$; the height f of the cavity in mm, the volume g of the cavity in $mm^3$; as concerns the insert of treating material, its diameter h in mm, its height i in mm, its front surface area j in $mm^2$, its total developed surface area k in $mm^2$, its volume 1 in $mm^3$, its module M=1/k in dm, the number n of holes in the chamber, not obstructed by the insert, the ratio R1 of the number n of non-obstructed holes to the total number b of the holes in the filter, the surface area p non-obstructed by the insert in $mm^2$, the ratio R1=p/e in %, the free space r in $mm^3$ occupied by the insert (r=g−1), the ratio R2 in % of the space r left free by the insert in the cavity to the total volume g of said cavity (R2=r/g).

Examples 5 and 6 did not yield fully satisfactory results and they are the prime cause of the lower limit equal to 10% for the ratio R1, as well as of the lower limit equal to 20% for the ratio R2. The most difficult conditions, i.e. when several pieces, whether identical or not, are cast at the same time in cells distributed around the runner of a same mould, have allowed the determination of lower and upper limits for advantageous and preferred ranges concerning both ratios R1 and R2.

Tables 1 and 2 show that the treating material insert 7 is, in an advantageous and preferred manner, in the shape of a plate or insert, the module M of which, or ratio of the volume to the total developed surface area of said insert, is an increasing function of the weight of said insert.

Table 2 shows that the module M of the insert is higher than at least 0.0050 dm, advantageously higher than at least 0.0100 dm, and preferably higher than at least 0.0150 dm.

Now, the weight of the treating material is in a known proportion to the weight of the molten metal, poured during a casting process. In a given mould and with a given filter, the casting time is substantially proportional to the weight of the molten metal to be cast and to be treated.

Table 3 gathers 6 examples, 21 through 26, with the respective characteristics of the corresponding filters and inserts.

Since the ratio of the weight of the treating material to the weight of the molten metal to be treated may vary within certain limits about a mean percentage, a given insert of treating material and a given filter can be used for cast metal weights within a certain range on both sides of an average weight of cast metal. In these circumstances, the casting time is substantially proportional to the weight of cast metal to be treated.

Therefore Table 3 shows, for each one of the mentioned 6 examples of filters and inserts, a cast metal weight range and a casting time range.

The Applicant has examined the ratio R3, defined as being the ratio of the weight of the cast metal to be treated, on the other hand, to the module of the insert of treating material multiplied by the cast metal velocity in the filter, on the other hand.

The insert module is given by the ratio M of the volume to the total developed surface area of said insert.

Moreover, the velocity of the cast metal within the filter is equal to the ratio of the weight of cast metal, on the one hand, to the surface area of the chamber multiplied by the casting time and by the density D of the molten metal, on the other hand.

Therefore, R3 equals S(p)×D×S(c)×(t)/V(p), where S(p) is the total developed surface area of the insert in $dm^2$, D is the density of the molten metal, S(c) is the front surface area of the filter cavity in $dm^2$, t is the time in seconds, V(p) is the insert volume in $dm^3$, which results in:

$$R3 = \frac{S(c) \times t \times D}{M(p)}$$

The value of the ratio R3, obtained from the average casting time in each one of the 6 examples, is also indicated in Table 3.

It can be noted that there is a gathering of the values of said ratio R3 round 70D, which is quite surprising.

Since the values, indicated in Table 3, correspond to an inoculating treatment of molten cast iron, and taking into account the limits of the ranges under consideration for the weight of cast metal or the casting time, the Applicant has been led to choose, as a criterion for the determination of the insert geometries, on the one hand, and of the filter geometries, on the other hand, the rule according to which the ratio R3, expressed in dm×sec, of the weight P in kg of the cast metal, on the one hand, to the module M of the insert, in dm, multiplied by the cast metal velocity inside the filter cavity, expressed in dm/sec, on the other hand, is in the order of 70D±50%, advantageously in the order of 70D±35%, and preferably in the order of 70D±20%, D being the density of the molten metal as expressed as a dimensionless ratio of the mass of a predetermined volume of the metal to the mass of the same volume of water.

The Applicant has also tried to find whether she could define a criterion which would be specific of the geometrical dimensions of the insert, as taken apart.

Therefore she has brought together, in Table 4, twelve examples, 31 through 42, of inserts the weights of which range from 10 g to 110 g, while selecting, for several insert weights, two suite different geometries, the one corresponding to a comparatively small diameter and a comparatively great thickness, and the other to a comparatively great diameter and a smaller height.

The Applicant has concerned herself with a first ratio R4, defined as being equal to the square root of the insert weight, divided by the module M of such insert.

Thus the Applicant has come to the conclusion that the insert of treating material should advantageously be dimensioned so that the ratio R4 of the square root of the weight P of said insert in grams, on the one hand, to its module M in decimetres, on the other hand, may be ranging between 80 and 280, advantageously between 100 and 260 and, more preferably, between 120 and 250.

Concurrently, the Applicant has thoroughly studied the value of ratio R5, which is the ratio of the cube root of the weight P of an insert in grams, on the one hand, to its module M in decimetres, on the other hand.

She has been led to define, as a criterion for the dimensioning of the inserts, the rule according to which the ratio R5 is most effectively ranging from 50 to 170, advantageously from 60 to 160 and, more preferably, from 75 to 130.

The ranges thus indicate- as regards the ratio R5 are narrower than those concerning the ratio R4. In all likelihood, this can be accounted for by the fact that ratio R5 is a dimensionless number, because its numerator, that is the cube root of the weight, is proportional to the cube root of the volume and may be expressed in decimetres, like its denominator, i.e. the module M.

Of course, the present invention is not intended to be restricted to the embodiments herein disclosed and it will readily be understood that various alterations and modifications can be made without departing from the scope of this invention.

More particularly, examples 21 through 26 and 31 through 42 relate to known inoculating treatments for liquid cast iron, whatever the cast iron grade in question may be, whether it be gray cast iron, compacted-graphite cast iron, spheroidal-graphite cast iron or similar.

Of course, the device according to the present invention can be used to treat other molten metals, in particular aluminium and its alloys, but also light alloys in general, and other ferrous and non-ferrous metals.

TABLE 1

| | | | FILTER | | | | FILTER CAVITY | | |
|---|---|---|---|---|---|---|---|---|---|
| | FILTER L × w × h × Ø in mm | INSERT weight in g | front surface area ($mm^2$) (a) | number of holes (b) | Ø of holes (mm) (c) | cross-sectional area ($mm^2$) (d) | surface area of cavity ($mm^2$) (e) | height of cavity (mm) (f) | volume of cavity ($mm^3$) (g) |
| EXAMPLE 1 | 40 × 40 × 22 × 2.5 | 10 | 1 600 | 95 | 2.35 | 412 | 1 024 | 11 | 11 264 |
| EXAMPLE 2 | 50 × 50 × 22 × 2 | 10 | 2 500 | 336 | 1.85 | 903 | 1 936 | 8 | 15 488 |
| EXAMPLE 3 | 50 × 50 × 22 × 2.5 | 10 | 2 500 | 176 | 2.35 | 763 | 1 764 | 8 | 14 112 |
| EXAMPLE 4 | Ø 50 × 21 × 2 | 10 | 1 963 | 193 | 1.85 | 519 | 1 385 | 8 | 11 080 |
| EXAMPLE 5 | Ø 50 × 21 × 2 | 20 | 1 963 | 193 | 1.85 | 519 | 1 385 | 8 | 11 080 |
| EXAMPLE 6 | Ø 50 × 21 × 2 | 20 | 1 963 | 193 | 1.85 | 519 | 1 385 | 8 | 11 080 |
| EXAMPLE 7 | 50 × 50 × 22 × 2.5 | 20 | 2 500 | 176 | 2.35 | 763 | 1 764 | 8 | 14 112 |
| EXAMPLE 8 | 55 × 55 × 22 × 2 | 20 | 3 025 | 418 | 1.85 | 1 123 | 2 401 | 8 | 19 208 |
| EXAMPLE 9 | 55 × 55 × 22 × 2 | 30 | 3 025 | 418 | 1.85 | 1 123 | 2 401 | 8 | 19 208 |
| EXAMPLE 10 | 60 × 60 × 22 × 2.5 | 40 | 3 600 | 246 | 2.35 | 1 067 | 2 704 | 10 | 27 040 |
| EXAMPLE 11 | 60 × 60 × 30 × 2.5 | 60 | 3 600 | 246 | 2.35 | 1 067 | 2 704 | 15 | 40 560 |
| EXAMPLE 12 | 75 × 50 × 22 × 2 | 20 | 3 750 | 352 | 1.85 | 946 | 2 814 | 8 | 22 512 |
| EXAMPLE 13 | 75 × 50 × 22 × 2.5 | 30 | 3 750 | 272 | 2.35 | 1 180 | 2 814 | 8 | 22 512 |
| EXAMPLE 14 | 71 × 71 × 23 × 2.5 | 40 | 5 041 | 404 | 2.35 | 1 752 | 3 969 | 9 | 35 721 |
| EXAMPLE 15 | 100 × 50 × 22 × 2.5 | 40 | 5 000 | 378 | 2.35 | 1 639 | 3 864 | 8 | 30 912 |
| EXAMPLE 16 | 81.5 × 81.5 × 31 × 2.5 | 100 | 6 642 | 598 | 2.35 | 2 594 | 5 402 | 20 | 108 040 |
| EXAMPLE 17 | 81.5 × 81.5 × 31 × 2.5 | 140 | 6 642 | 598 | 2.35 | 2 594 | 5 402 | 20 | 108 040 |

TABLE 2

| | INSERT | | | | | | RATIO | | | | | |
|---|---|---|---|---|---|---|---|---|---|---|---|---|
| | Ø (mm) (h) | height (mm) (i) | front surface area ($mm^2$) (j) | developed surface area ($mm^2$) (k) | volume ($mm^3$) (l) | module M = l/k | number of non-obstructed holes (n) | R1 (%) n/b (o) | non-obstructed surface area ($mm^2$) (p) | p/e % (q) | free space ($mm^3$) (r) | R2 (%) n/b (s) |
| EX 1 | 30 | 6 | 707 | 1 979 | 4 242 | 0.0214 | 29 | 30 | 317 | 31 | 7 022 | 62 |
| EX 2 | 30 | 6 | 707 | 1 979 | 4 242 | 0.0214 | 214 | 64 | 1 229 | 63 | 11 246 | 72 |
| EX 3 | 30 | 6 | 707 | 1 979 | 4 242 | 0.0214 | 104 | 59 | 1 057 | 60 | 9 870 | 70 |
| EX 15 | 30 | 6 | 707 | 1 979 | 4 242 | 0.0214 | 93 | 48 | 678 | 49 | 6 838 | 62 |
| EX 16 | 34 × 34 | 6 | 1 156 | 3 128 | 6 936 | 0.0222 | 22 | 11 | 229 | 17 | 4 144 | 37 |
| EX 17 | 38 | 7 | 1 134 | 3 104 | 7 938 | 0.0256 | 24 | 12 | 251 | 18 | 3 142 | 28 |
| EX 4 | 38 | 7 | 1 134 | 3 104 | 7 938 | 0.0256 | 62 | 35 | 630 | 36 | 6 174 | 44 |
| EX 5 | 38 | 7 | 1 134 | 3 104 | 7 938 | 0.0256 | 221 | 53 | 1 267 | 53 | 11 270 | 59 |
| EX 6 | 47 | 7 | 1 735 | 4 504 | 12 145 | 0.0270 | 116 | 28 | 666 | 28 | 7 063 | 37 |

TABLE 2-continued

| | INSERT | | | | | RATIO | | | | | | |
|---|---|---|---|---|---|---|---|---|---|---|---|---|
| | Ø (mm) (h) | height (mm) (i) | front surface area ($mm^2$) (j) | developed surface area ($mm^2$) (k) | volume ($mm^3$) (l) | module M = l/k | number of non-obstructed holes (n) | R1 (%) n/b (o) | non-obstructed surface area ($mm^2$) (p) | p/e % (q) | free space ($mm^3$) (r) | R2 (%) n/b (s) |
| EX 7 | 50.8 | 8.6 | 2 027 | 5 426 | 17 432 | 0.0321 | 60 | 24 | 677 | 25 | 9 608 | 36 |
| EX 8 | 50.8 | 12.5 | 2 027 | 6 049 | 25 338 | 0.0419 | 60 | 24 | 677 | 25 | 15 222 | 38 |
| EX 9 | 38 | 7 | 1 134 | 3 104 | 7 938 | 0.0256 | 212 | 60 | 1 680 | 60 | 14 574 | 65 |
| EX 10 | 38/30 | 7/6 | 1 841 | 5 083 | 12 180 | 0.0240 | 94 | 35 | 973 | 35 | 10 332 | 46 |
| EX 11 | 50.8 | 8.6 | 2 027 | 5 426 | 17 432 | 0.0321 | 197 | 49 | 1 942 | 49 | 18 289 | 51 |
| EX 12 | 2 × 38 | 7 | 2 268 | 6 208 | 15 876 | 0.0256 | 154 | 41 | 1 596 | 41 | 15 036 | 49 |
| EX 13 | 57 | 15 | 2 552 | 7 790 | 38 283 | 0.0491 | 315 | 53 | 2 850 | 53 | 69 760 | 65 |
| EX 14 | 72 | 14 | 4 072 | 11 311 | 57 008 | 0.0504 | 147 | 25 | 1 330 | 25 | 51 032 | 47 |

TABLE 3

| | FILTER | | INSERT | | | | CASTING PROCESS | | | |
|---|---|---|---|---|---|---|---|---|---|---|
| | L × w × h × Ø mm | S(c) $dm^2$ | weight (g) | Ø (mm) | height (mm) | module M (dm) | weight kg | casting time sec | average time sec | R3 |
| EX 21 | 50 × 50 × 22 × 2.5 | 0.1764 | 10 | 38 | 4 | 0.0165 | 12 to 18 | 6 to 8 | 7 | 74.83 D |
| EX 22 | 50 × 50 × 22 × 2.5 | 0.1764 | 10 | 30 | 6 | 0.0214 | 12 to 18 | 7 to 10 | 8.5 | 70.06 D |
| EX 23 | 50 × 50 × 22 × 2.5 | 0.1764 | 20 | 38 | 7 | 0.0256 | 20 to 30 | 8 to 12 | 10 | 68.91 D |
| EX 24 | 50 × 50 × 22 × 2.5 | 0.1764 | 20 | 25.4 | 14 | 0.0343 | 20 to 30 | 10 to 15 | 12.5 | 64.29 D |
| EX 25 | 60 × 60 × 30 × 2.5 | 0.2704 | 60 | 51 | 13 | 0.0431 | 50 to 80 | 10 to 12 | 11 | 69.01 D |
| EX 26 | 60 × 60 × 30 × 2.5 | 0.2704 | 60 | 38 | 20 | 0.0487 | 50 to 80 | 10 to 15 | 12.5 | 69.40 D |

$$R3 = \frac{S(c) \times t \times D}{M}$$

TABLE 4

| | weight P (g) | Ø (mm) | h (dm) | M (dm) | R4 $\sqrt{P/M}$ | R5 $\sqrt[3]{P/M}$ |
|---|---|---|---|---|---|---|
| EX 31 | 10 | 25.4 | 7.5 | 0.0236 | 134 | 91.3 |
| EX 32 | 10 | 30 | 6 | 0.0214 | 148 | 100.6 |
| EX 33 | 20 | 38.1 | 6.3 | 0.0237 | 189 | 114.5 |
| EX 34 | 20 | 25.4 | 17 | 0.0363 | 130 | 74.8 |
| EX 35 | 30 | 38.1 | 9 | 0.0306 | 179 | 101.5 |
| EX 36 | 30 | 46 | 6.5 | 0.0253 | 216 | 122.8 |
| EX 37 | 40 | 50.8 | 8.6 | 0.0321 | 197 | 106.5 |
| EX 38 | 40 | 38.1 | 14.8 | 0.0416 | 152 | 82.2 |
| EX 39 | 60 | 50.8 | 12.3 | 0.0414 | 187 | 94.5 |
| EX 40 | 60 | 38.1 | 21 | 0.0499 | 155 | 78.4 |
| EX 41 | 80 | 46 | 16 | 0.0472 | 189 | 91.3 |
| EX 42 | 110 | 56 | 15 | 0.0482 | 218 | 99.4 |

$$R4 = \sqrt{P/M}$$

$$R5 = \sqrt[3]{P/M}$$

What is claimed is:

1. Device (1) for filtering and treating molten metal, comprising a set of at least two filtering plates (2, 3), consisting of a refractory mineral material and having through-holes **(4, 4*a*) for the passage and the filtration of the molten metal, such filtering plates being kept at a certain distance apart by means of peripheral walls (5) so as to provide, between them, a cavity (6) receiving an insert (7) made of a treating material for said molten metal and having such a shape that, as seen in the direction of flow (8) of the molten metal, the insert (7) leaves at least one uncovered area (9) on the filtering plates (2, 3), said insert having a module which is the ratio of the volume to the total developed surface area of said insert wherein the ratio (R1) of the number of free holes (4*a*) in a filtering plate (2, 3), located in the areas (9) which are not covered by the insert (7) of treating material, on the one hand, to the total number of holes (4, 4*a*) in said filtering plate (2, 3)**, on the other hand, is not less than 10% and not above 75%.

2. Device according to claim 1, wherein the ratio (R2) of the space not occupied in the cavity (6) by the insert (7) of treating material, on the one hand, to the total volume of said cavity (6), on the other hand, is not less than 20% and not above 80%.

3. Device according to claim 1, wherein, for an inoculation treatment of molten cast iron, the ratio (R3), expressed in dm×sec, of the weight (P) in kg of the cast metal, on the one hand, to the module (M) of the insert, in dm, multiplied by the cast metal velocity inside the filter chamber, expressed in dm/sec, on the other hand, is in the order of 70D±50%, D being the density of the molten metal as expressed as a dimensionless ratio of the mass of a predetermined volume of the metal to the mass of the same volume of water.

4. Device according to claim 1, wherein the module (M) of the insert is higher than at least 0.0050 dm.

5. Device according to claim 1, wherein the insert of treating material is so dimensioned that the ratio (R4) of the square root of the weight (P) of said insert in grams, on the one hand, to its module (M) in dm, on the other hand, ranges between 80 and 280.

6. Device according to claim 1, wherein the insert of treating material is so dimensioned that the ratio (R5) of the cube root of the weight (P) of said insert in grams, on the one hand, to its module (M) in dm, on the other hand, ranges from 50 to 170.

7. Device according to claim 1, wherein the treating material, constituting the insert (7), is selected from group consisting of desulfurizing, heat-producing, inoculating, spherodizing, recarburizing, refining, modifying agents, and from addition alloys.

8. Device according to claim 1, wherein the weight of the treating material ranges from about 0.001% to about 1% of the weight of the molten metal to be treated.

9. Device according to claim 1, wherein the filtrating holes (4, 4*a*) have a diameter in the range from about 1.5 mm to about 3 mm.

10. Device as claimed in claim 1, wherein said treating material is an inoculating material.

11. Device as claimed in claim 10, wherein said inoculating material is chosen from the group of compositions consisting of iron alloys, magnesium, lithium compounds, strontium compounds, barium compounds, silicon, zirconium, aluminium, rare earths, graphite, carbon.

12. Use of a device according to claim 1, in a method of mould casting a molten metal, comprising the steps of interposing a filter and a treating material on the way of the molten metal before said metal enters the actual mould.

13. The device of claim 1, wherein the ratio (R1) is not less than 20% and not above 65%.

14. The device of claim 13, wherein the ratio (R1) is not less than 35% and not above 50%.

15. The device of claim 2, wherein the ratio (R2) is not less than 30% and not above 75%.

16. The device of claim 15, wherein the ratio (R2) is not less than 35% and not above 72%.

17. The device of claim 4, wherein the module (M) is higher than at least 0.0100 dm.

18. The device of claim 17, wherein the module (M) is higher than at least 0.0150 dm.

19. The device of claim 5, wherein the ratio (R4) is between 100 and 260.

20. The device of claim 19, wherein the ratio (R4) is between 120 and 250.

21. The device of claim 6, wherein the ratio (R5) ranges from 60 to 160.

22. The device of claim 21, wherein the ratio (R5) ranges from 75 to 130.

23. The device of claim 9, wherein the diameter of the filtrating holes is from about 1.8 to about 2.5 mm.

24. The device of claim 3, wherein the ratio (R3) is in the order of 70D±35%.

25. The device of claim 24, wherein the ratio (R3) is in the order of 70D±20%.

* * * * *